US012599186B1

(12) United States Patent
Purio et al.

(10) Patent No.: US 12,599,186 B1
(45) Date of Patent: Apr. 14, 2026

(54) GOWN WITH CUFF HAVING INTEGRATED PERFORATIONS

(71) Applicants: Andrew Purio, Las Vegas, NV (US); Jason Greninger, Las Vegas, NV (US)

(72) Inventors: Andrew Purio, Las Vegas, NV (US); Jason Greninger, Las Vegas, NV (US)

( * ) Notice: Subject to any disclaimer, the term of this patent is extended or adjusted under 35 U.S.C. 154(b) by 11 days.

(21) Appl. No.: 19/080,159

(22) Filed: Mar. 14, 2025

Related U.S. Application Data

(63) Continuation-in-part of application No. 18/105,202, filed on Feb. 2, 2023, now abandoned.

(51) Int. Cl.
*A41D 13/12* (2006.01)

(52) U.S. Cl.
CPC ..... *A41D 13/1227* (2013.01); *A41D 13/12* (2013.01); *A41D 13/1209* (2013.01); *A41D 13/129* (2013.01)

(58) Field of Classification Search
CPC ..... A41D 13/1227; A41D 13/12; A41D 13/1209; A41D 13/129
See application file for complete search history.

(56) References Cited

U.S. PATENT DOCUMENTS

| | | | | |
|---|---|---|---|---|
| 5,142,704 | A | 9/1992 | Viemeister | |
| 6,449,772 | B1 | 9/2002 | Donner | |
| 2003/0046748 | A1 | 3/2003 | Tanenbaum | |
| 2003/0106131 | A1 | 6/2003 | Tremblay | |
| 2007/0000021 | A1* | 1/2007 | Yang | A41D 19/0006 2/161.6 |
| 2018/0092412 | A1 | 4/2018 | Genender | |
| 2021/0401091 | A1* | 12/2021 | Wilfong | A41D 13/1209 |

* cited by examiner

*Primary Examiner* — Khaled Annis
(74) *Attorney, Agent, or Firm* — Bold IP, PLLC; Houda El-Jarrah

(57) ABSTRACT

A hospital-type gown or surgical gown, featuring a new sleeve end or cuff design and method of manufacture. The garment includes a main body and sleeves, with the distal end of each sleeve or cuff is constructed to provide optional superior protection and retention within a glove. The novel cuff or sleeve end design provides for perforations within an intact cuff that may allow the passage of a finger, and yet that integrity of wrist and glove junction has not been compromised when not used, and when used provides superior anchor to the wearer's thumb, and pinkie and or finger(s), inside the glove, offering improved protection and/or padding for the hand and wrist.

7 Claims, 9 Drawing Sheets

GOWN WITH CUFF HAVING INTEGRATED PERFORATIONS

CROSS-REFERENCE TO RELATED APPLICATIONS

This application is a continuation in part application of non-provisional application Ser. No. 18/105,202, which was filed on Feb. 2, 2023, which, is incorporated herein in its entirety.

FIELD OF THE INVENTION

This invention relates to a hospital-type gown sleeve end, and or cuff which may be in the form of a disposable or launderable gown, and in particular to a gown of the type used by surgeons, surgical assistants, doctors, nurses, nurse's aides, and the like for surgical, isolation, biohazard, flue, or other personal protective equipment PPE needs responsive to the task and protection needed. The non-limiting embodiments described in the present description may provide superior glove and cuff integrity.

BRIEF SUMMARY OF THE INVENTION

This disclosure provides a new hospital-type gown with a sleeve end or cuff design responsive specific to failures in aseptic and sterile technique at the dynamic junction of glove and sleeve.

The disclosure embodies a design in which the gown sleeve end, or cuff, is anchored to the thumb and or fingers specifically in a way to provide superior cuff position and gown end or cuff to glove integrity, and thus superior sterile and aseptic technique, this positions the cuff or gown sleeve end properly in position within the glove and anchoring it in place irrespective to movement. Cuff design can incorporate various materials used for similar personal protective equipment (PPE), protection, padding, and or moisture imperviousness, as the needs of the protection equipment applications indicate.

In a non-limiting embodiment, the present description may relate to an apparatus comprising a gown having a sleeve end or a cuff, wherein the sleeve end and or the cuff comprises a thumb perforation, wherein the thumb perforation is a narrow opening or slit located a distance below a top edge of the sleeve end or the cuff that is configured to receive a thumb, wherein the thumb perforation is not a widened hole prior to insertion of the thumb into the perforation. In a non-limiting embodiment, the cuff may comprise an additional pinkie perforation configured to receive a pinkie. The perforations may be covered with a breakable seal to prevent the perforations from opening excessively wide without intentional force being applied by a user's thumb, pinkie, or another finger. The integration of the perforations allows for optional use of the perforations by the user without breaking or compromising the sterility of the cuff if the perforations are unused.

DETAILED DESCRIPTION

The present description includes a modified design for a cuff of a gown that enhances sterile and aseptic technique, increases patient and wearer safety, and aids in preventing disease transmission. The invention addresses key concerns in medical apparel by combining improved functionality with enhanced protective infection control features.

Figure 1:
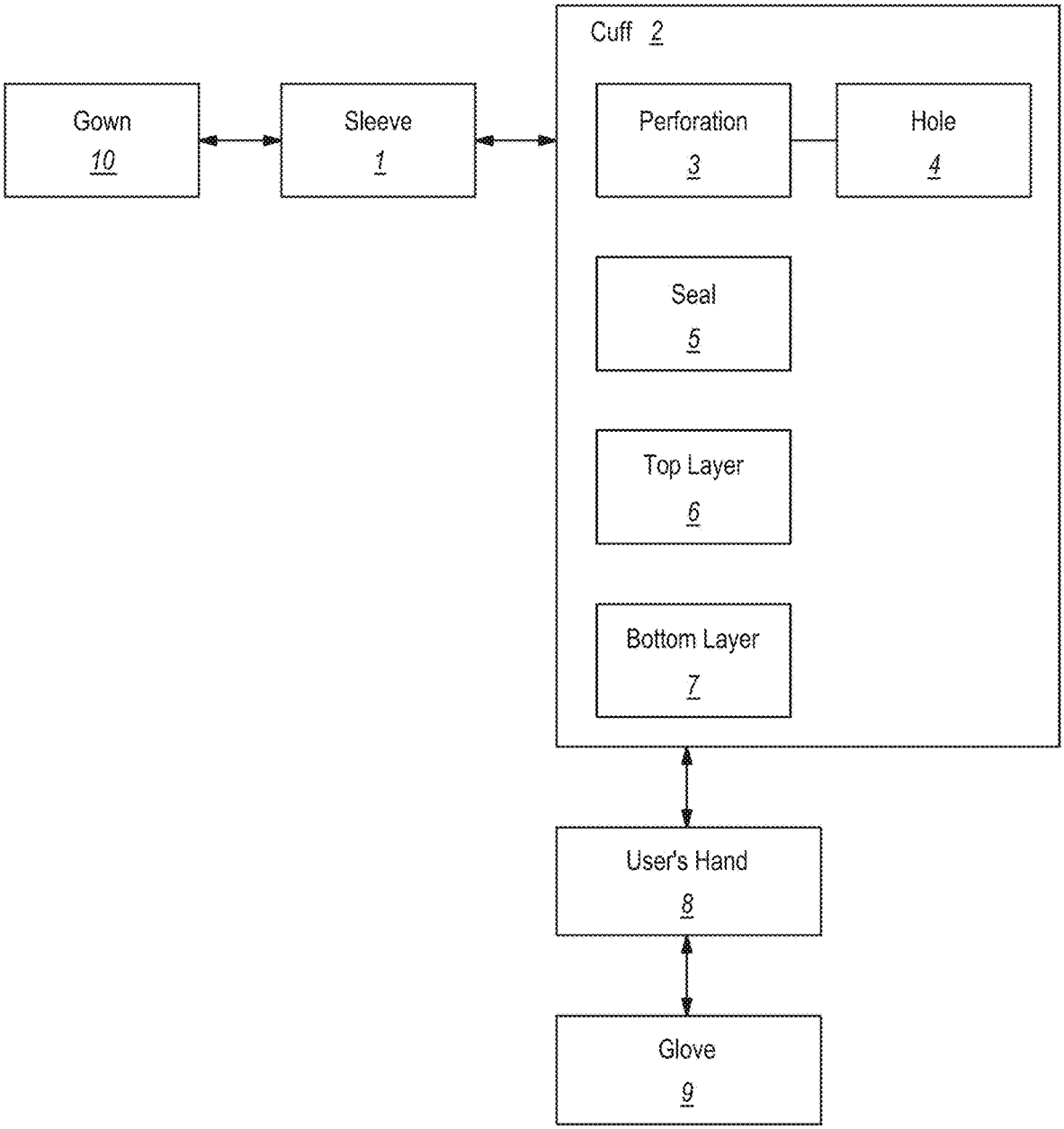
FIG. 1 shows a block diagram of one or more components of a cuff for a hospital/surgical gown.

FIG. 1 is a block diagram illustrating exemplary components for a modified hospital/surgical gown 10 having a modified cuff 2 or sleeve end. FIG. 1 includes a surgical gown 10 that has a cuff 2 for each left and right sleeve 1. The cuff 2 may have one or more perforations 3 integrated into the cuff 2 (including at a thumb and/or pinkie or another digit in a non-limiting embodiment).

Figure 4:
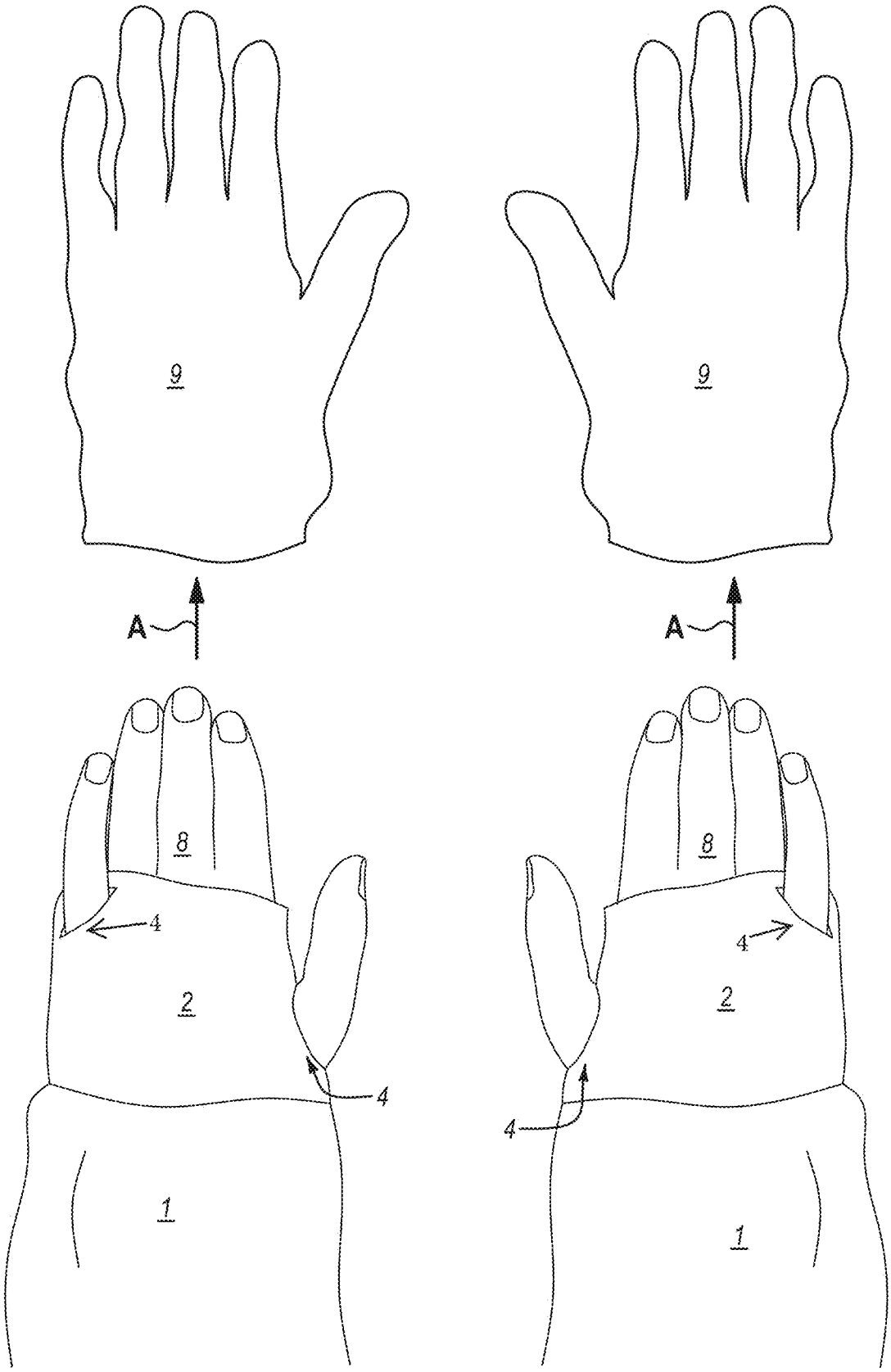
FIG. 4 shows the cuff of FIG. 3 in use with a thumb and pinkie inserted into the integrated thumb perforation and integrated pinkie perforation and other fingers extending through the cuff.

A perforation 3 has referred to or defined herein is a very narrow slit or opening and is different from a hole 4. A hole 4 as defined herein is a fully formed, wider opening having a wider cavity than the opening of a perforation 3 that persists in staying open whereas a perforation 3 is a very narrow sit. Accordingly, a perforation 3 is not a same size as a hole 4 as used herein. Notably, a perforation 3 may become a hole 4 (e.g., as shown in FIG. 4 and in FIG. 5) after a user creates the hole 4 by inserting a finger, such as a thumb or pinkie, through the dedicated perforation 3 integrated into the cuff 2.

Figure 3:
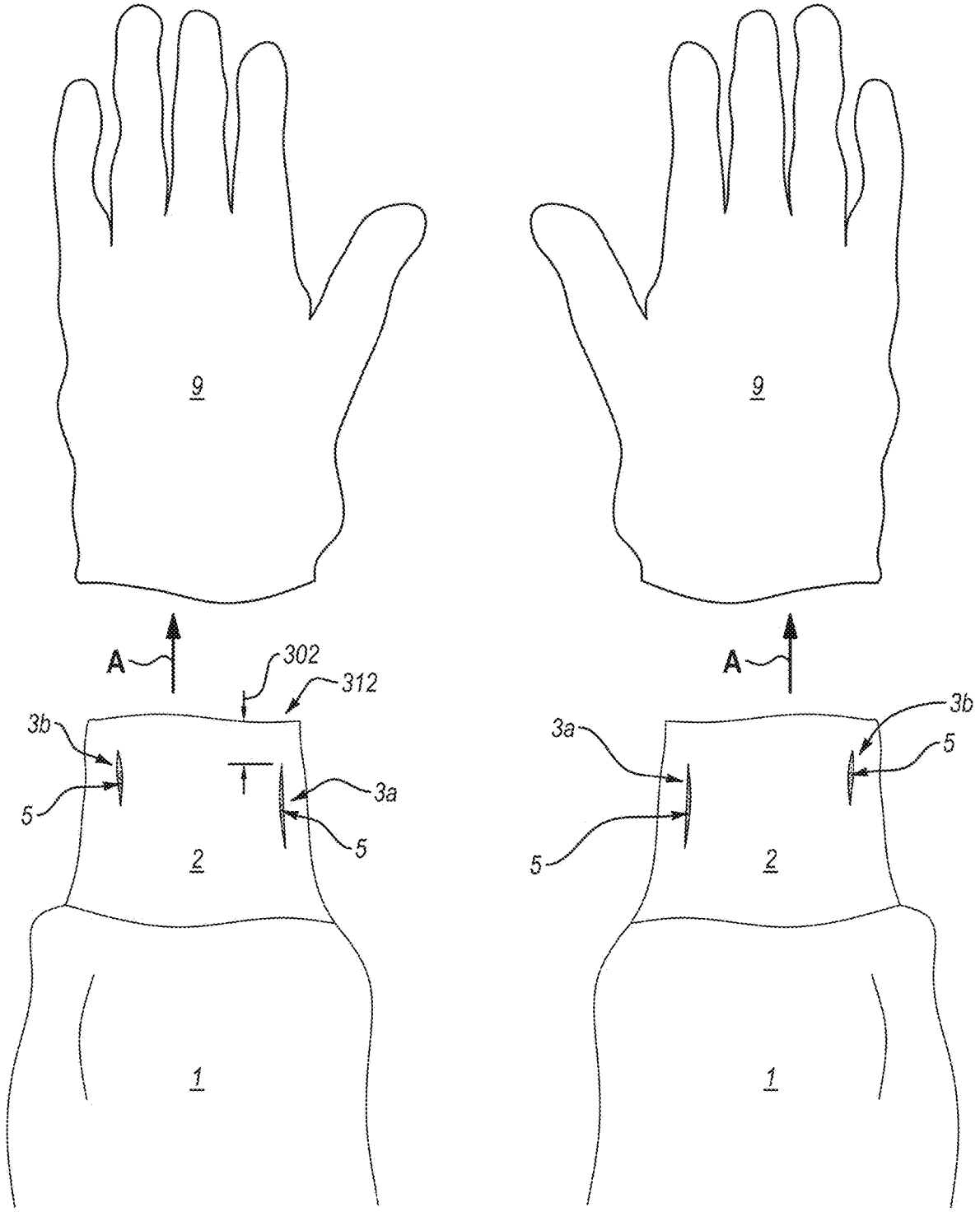
FIG. 3 shows an example of a cuff at an end of the sleeve of a gown with an integrated thumb perforation and pinkie perforation.

The perforations 3 may comprise a breakable seal 5 (e.g., as shown in FIG. 3) covering smaller slit or opening of the perforations 3. The breakable, temporary seal 5 may cause the sides of the perforations 3 to be joined together and/or include a material layer in between the sides of the open perforation 3 so as to prevent an open slit or interior cavity for the perforation 3. In a non-limiting embodiment, the breakable seal 5 may be a type of heat seal. A heat seal, as used herein, refers to the method of joining two materials or two sides of the perforations 3 integrated into the cuff 2 together by applying heat and pressure, essentially welding the materials together to create a secure seal. The sides of the perforations 3 in this manner may be fused together, which further ensures that the perforations 3 do not cause a break in the integrity of the cuff 2. The heat seal 5 may involve heating the edges of the material on the cuff 2 after the perforations 3 are formed in the cuff 2 slightly so the edges fuse together when pressed together and cool down, forming a breakable seal above the perforation 3. The breakable seal 5 helps prevent the perforations 3 from opening too wide unless a digit (e.g., a thumb or pinkie or other digit) is inserted therein forcefully and on purpose by the user, thereby providing full cuff integrity and proper current aseptic technique if the perforations 3 are unused for the thumb and/or pinkie (as further described below and reflected in FIGS. 3-9 in different ways). A heat seal used for the seal 5 may be useful as it helps ensure sanitation and sterility which is vital in a medical environment. In alternative embodiments, Other types of seals 5 may alternatively be used other than a heat seal, as known in the art, including but not limited to adhesive sealants, such as, but not limited to silicone sealants.

Figure 2:
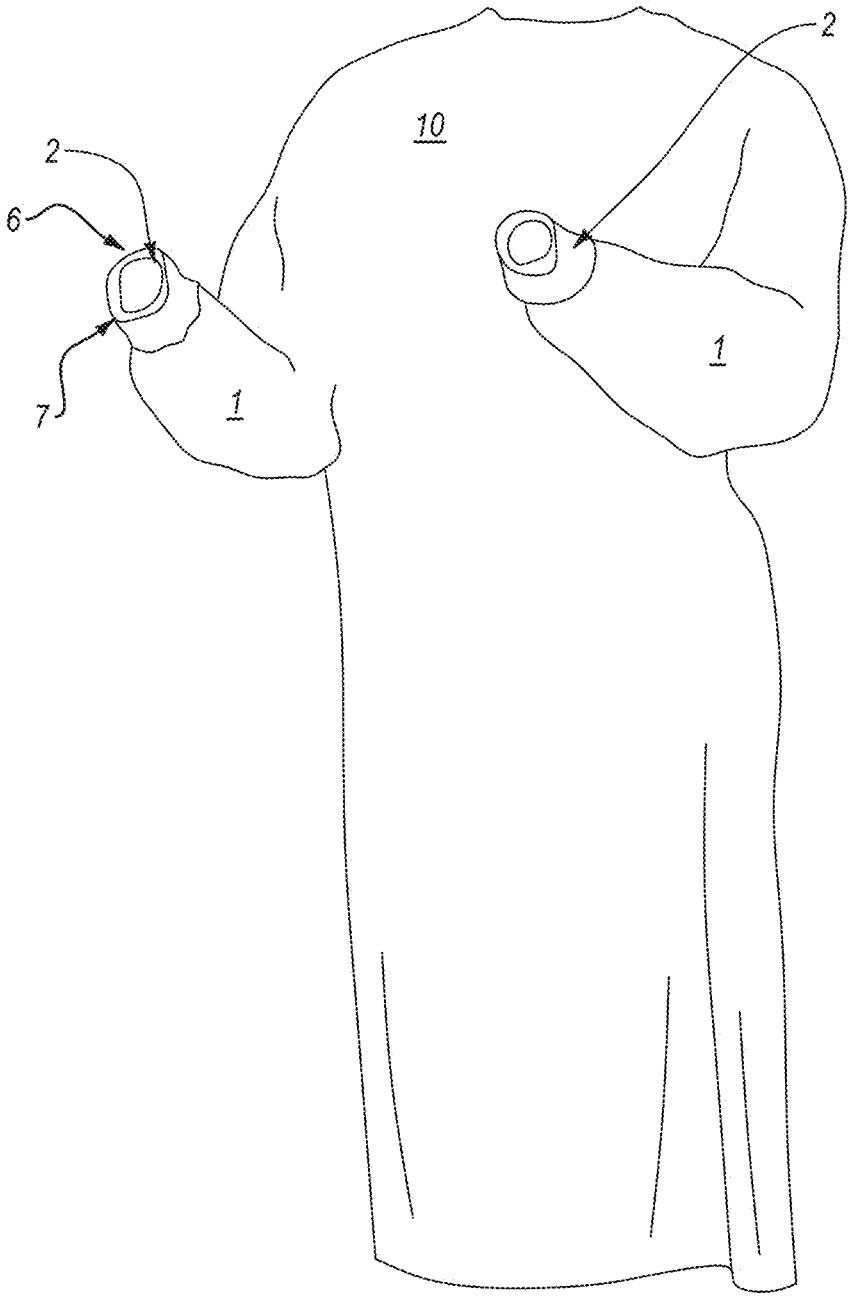
FIG. 2 shows an example of a hospital/surgical gown.

The cuff 2 of the gown 10 may be made from stretchable material and folded over so that there are two layers, a top layer 6 and a bottom layer 7, as shown in FIG. 2 in an illustrative embodiment and in FIG. 1 in the block diagram.

FIG. 2 shows a non-limiting example of a hospital/surgical gown 10 which has sleeves 1 to cover the right arm and the left arm and which has a cuff 2 at the end of each sleeve 1. The cuff 2 has a folded over material that has a top layer 6 and a bottom layer 7. The user is intended to wear the hospital/surgical gown 10 by inserting the user's arms and hands through each left and right sleeve 1 of the surgical gown 10 such that the front side of the gown 10 covers the body of the user. The user's hands 8 extend through the left and right sleeve 1 respectively and into a glove 9 dedicated for each left and right hand 8. The present description includes description for how the user may optionally choose to insert his thumb or pinkie into a thumb perforation 3*a* and a pinkie perforation 3*b* (e.g. as shown in FIG. 3). Alternatively, other types of gowns may be worn that are placed on the back first and worn like a traditional coat or jacket which may integrate the modified cuffs 2 as shown in FIGS. 3-9.

The present invention includes modifying prior art cuffs of existing surgical gowns 10 by the incorporation of perforations 3 strategically positioned for the thumb and/or pinkie in one or more non-limiting embodiment. Further information is provided below with respect to the Figures.

As shown in FIG. 3, a gown 10 may incorporate a sleeve 1 having a cuff area or distal sleeve end 2 whereby there is no change of materials from gown 10 to the distal sleeve end of the garment. The cuff 2 incorporates an integrated thumb perforation 3*a* and/or pinkie perforation 3*b*, positioned responsive to protection and donning position, and need. The user is intended to insert the user's sleeves and hands 8 into the gloves 9 in the direction of arrows A as shown in FIG. 3. In a non-limiting embodiment, a seal, such as heat seal 5 may be integrated with each thumb perforation 3*a* and/or pinkie perforation 3*b*.

FIG. 3 shows that the thumb perforation 3*a* for each cuff 2 is located a distance 302 below the top edge 312 of each cuff 2. Similarly, the pinkie perforation 3*b* is located a distance below the top edge 312 of each cuff 2.

The perforation design for the thumb perforation 3*a* and/or pinkie perforation 3*b* allows for easy press through or manipulation through to access when needed, without compromising the sleeve or cuff integrity of the gown 10, sleeve 1, and cuff 2 if not used. The perforations within the cuff 2 and/or sleeve end, for the thumb and/or pinkie as shown in FIGS. 3-9 may be any shape or pattern useful for the digit to pass through, providing an anchor to the cuff 2 or sleeve end, with the thumb and/or pinkie. Advantageously, if the user chooses not to use the thumb perforation 3*a* and/or pinkie perforation 3*b*, the unused perforation 3*a*, 3*b* does not compromise the integrity of the sleeve end, or cuff 2.

Figure 8:
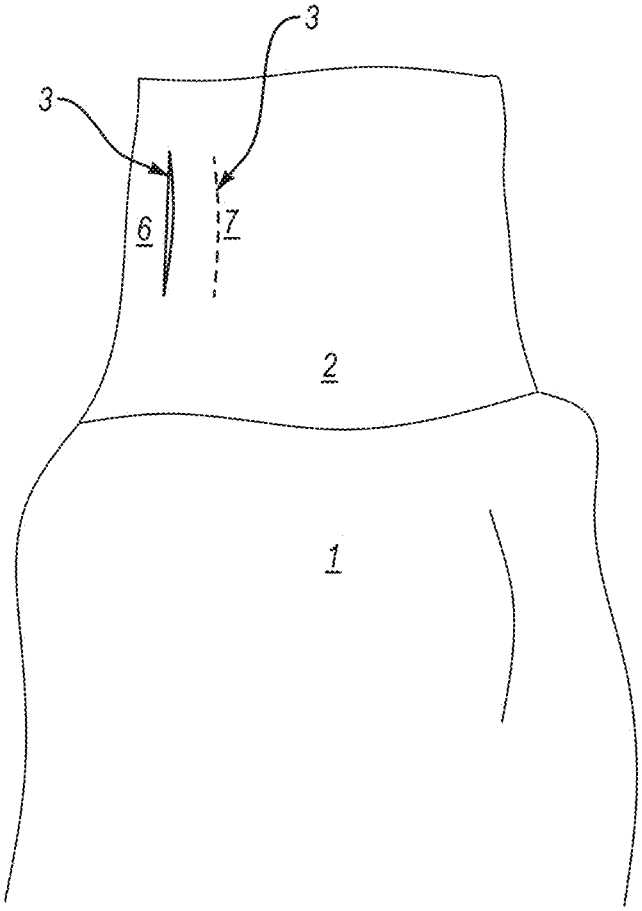
FIG. 8 shows a surgical gown cuff or sleeve end that has two layers and a perforation in a top layer and/or a bottom layer of the cuff.
Figure 9:
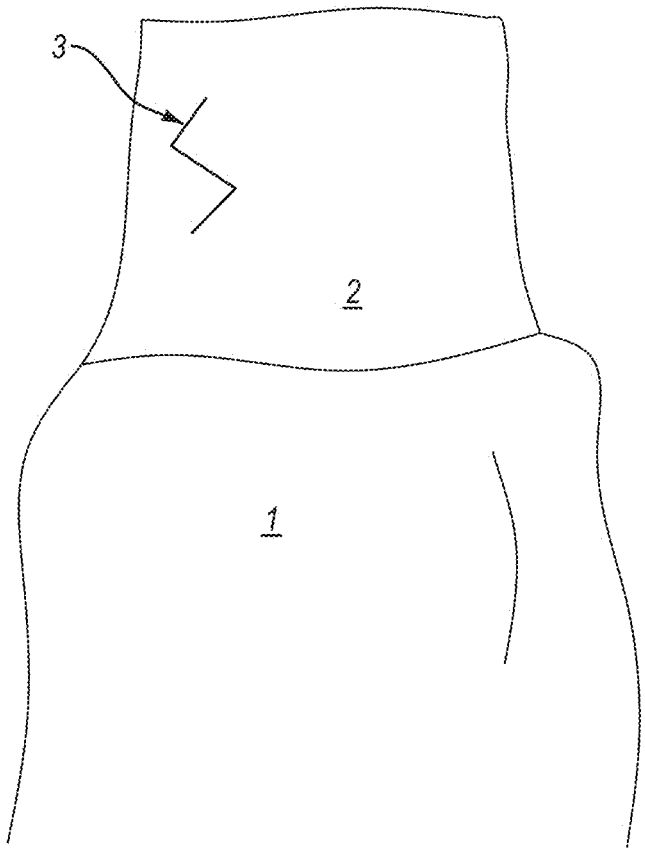
FIG. 9 shows another example of an optional shape of a perforation integrated into the cuff of the gown.

FIG. 3 shows one example of a shape for the perforations 3*a*, 3*b* which may include a narrow line for the narrow slit. FIG. 9 shows another example in which the perforation 3 is in a zig-zag design. The design and shape of the perforation 3*a*,3*b* may be variable and include straight, zig-zag, or other designs while the perforations 3 are still generally narrow, thin slits or narrow openings integrated into a material or web of the cuff 2. FIG. 8 further shows a visual non-limiting example in which a perforation 3 may be incorporated into a top layer 6 of the cuff 2 as well as through a bottom layer 7 of the cuff 2. Accordingly, the perforations 3 may be formed sometimes only in one layer (e.g. a top layer 6 of the cuff 2) and/or via two layers (e.g., the top layer 6 and bottom layer 7) of the cuff 2 in other embodiments.

The perforations 3 may be created with hole tooling, and or rouletting, and or laser, and or punch and die, all with or without heating. The perforation 3 regardless of method used will leave an intact cuff 2 providing full cuff integrity and proper current aseptic technique if the perforations 3 are unused for the thumb and/or pinkie, as the thumb and/or pinkie must press or manipulate through the thumb perforation 3*a* or the pinkie perforation 3*b*. If the perforations 3*a*, 3*b* are penetrated by the respective thumb or pinkie, the perforations 3*a*, 3*b* become a hole 4, whereby as noted above, a hole 4 is a wider opening than the narrow slit of the thumb perforations 3*a*, 3*b*. Notably, each thumb perforation 3*a* may include a seal 5, including, but not limited to, a seal 5 created as a heat seal. Further, FIG. 4 shows an example where the user has applied the force of the thumb to cause the thumb to penetrate through the seal 5 (optionally integrated in a non-limiting embodiment) of the thumb perforation 3*a* causing the thumb perforation 3*a* to become a hole 4 such that the thumb extends out through the created thumb hole 4 on the left and right hand 8 of the cuff 2.

Further FIG. 4 shows an example where the user has applied the force of the pinkie to cause the pinkie to penetrate through the underside of the perforation 3 and/or through the underside of the breakable seal 5 (optionally integrated in a non-limiting embodiment) of the pinkie perforation 3*b* causing the pinkie perforation to become a pinkie hole 4 such that the pinkie extends out through the created pinkie hole 4 on the left and right hand 8 of the cuff 2.

FIG. 4 further shows that the remaining digits on the hand 8 are extending through the terminal end of the cuff 2, while the thumbs and pinkie extend through the cuff 2 via the holes 4 that were created from the perforations 3*a*, 3*b* that were pre-made and pre-formed into the cuff 2.

Figure 5:
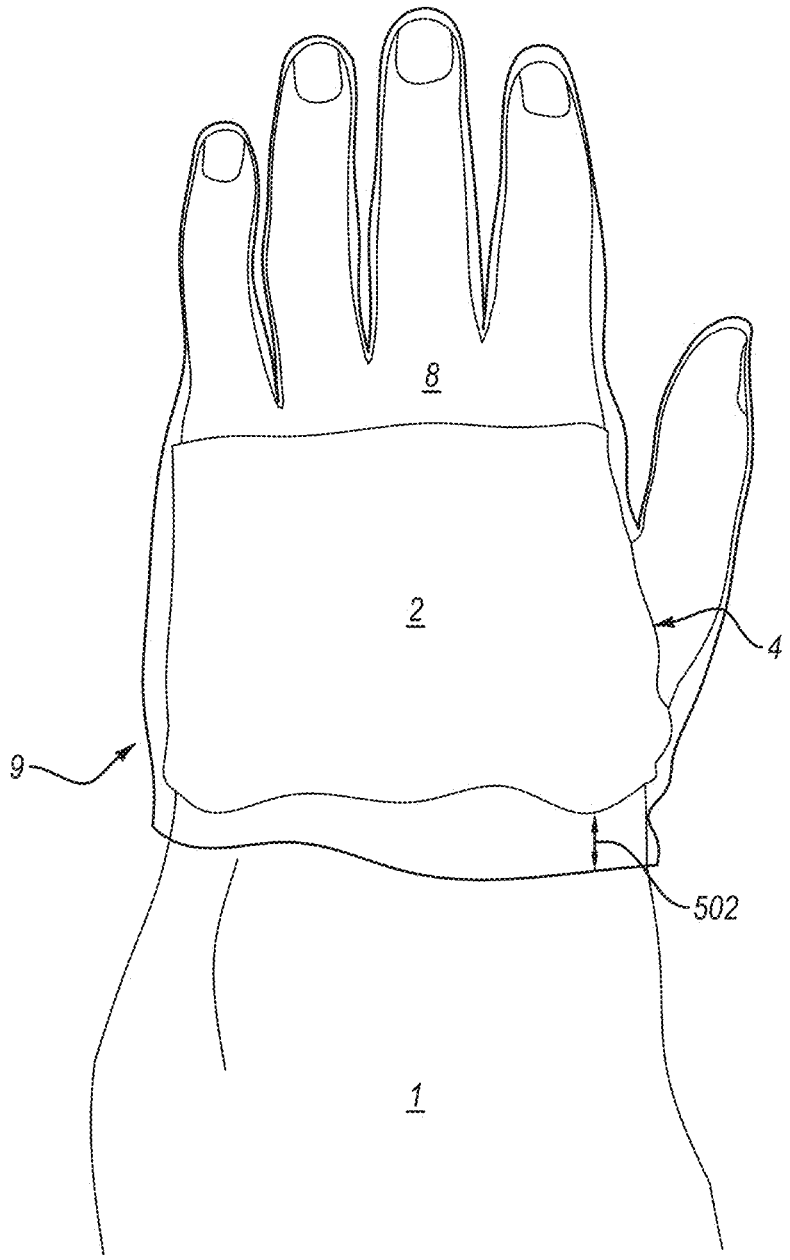
FIG. 5 shows a non-limiting in use example of a cuff at an end of a hospital/surgical gown inserted within a glove with the thumb hole created from the thumb perforation.

FIG. 5 shows that the glove 9 may be pulled down over the cuff 2 with the thumb extending through the hole 4 created from a thumb perforation 3*a* (e.g. as shown in FIG. 3). The glove 9 may extend a distance 502 beyond the edge of the cuff 2 and further ensure the sterility of the gown 10, sleeve 1 end, and cuff 2.

Figure 6:
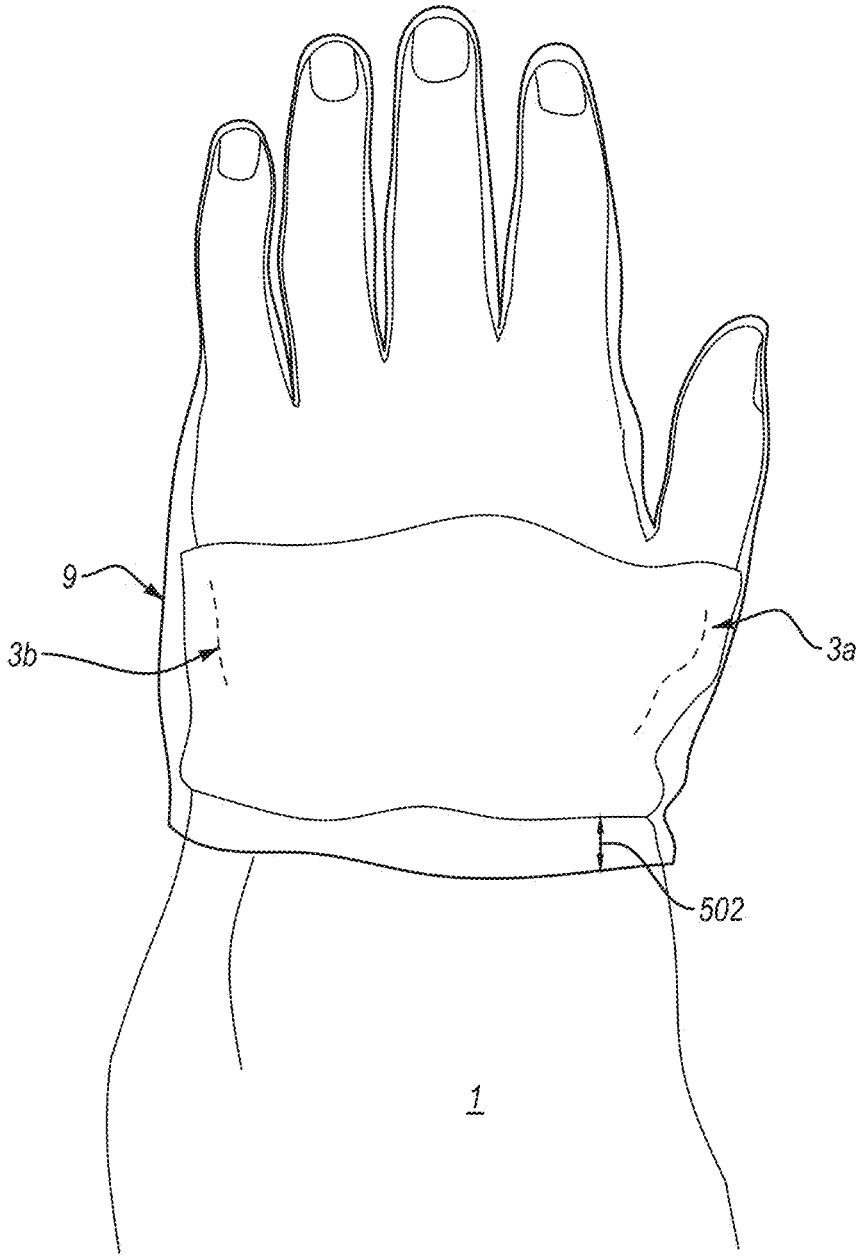
FIG. 6 shows a non-limiting illustration of the cuff of a surgical gown or sleeve end with non-use of a thumb perforation, without compromising the integrity of the cuff or sleeve end inside of the glove.

FIG. 6 shows that the integrated thumb perforation 3*a* and/or pinkie perforation 3*b* may remain intact when the user choose not to use the perforations 3*a*, 3*b*. Accordingly, the use of the perforations 3*a*, 3*b* is optional to the user. The user may push all the fingers of the hand 8 through the opening of the cuff 2 and into the glove 9 as shown in FIG. 6, and the perforations 3*a*, 3*b* will remain closed and intact or unopened, in particular, when a seal, such as seal 5 is integrated onto the perforations 3. In this manner, the perforations 3 offer a better means of ensuring glove/cuff integrity and reduce any break in sterility because of the narrow size of the perforations 3 as opposed to a hole 4 which if left unused such that the thumb and/or pinkie were not inserted into the hole 4, there could potentially be a break in glove/cuff integrity and a break in sterility.

Figure 7:
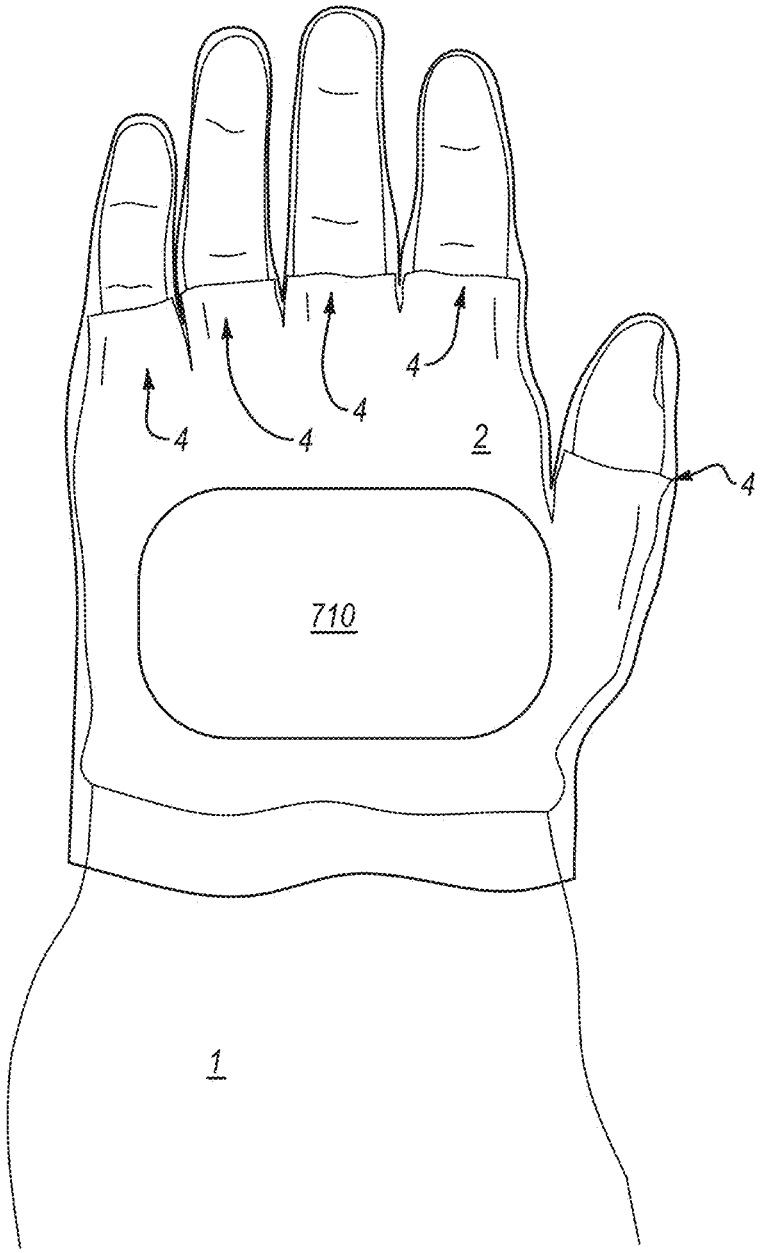
FIG. 7 shows a non-limiting use of a second embodiment of the cuff of the surgical gown or sleeve end with openings/holes for all digits, and an optional padding incorporated on the cuff.

FIG. 7 illustrates optional fingers holes 4 and/or an optional padding 710 on the cuff area 2 as needed. The padding 710 may be located in such a way to coordinate with the anterior, or posterior hand, or logically positioned on the cuff area 2 responsive for extra protection. The padding 710 may be located on a top or bottom or side of the cuff area 2 at the end of the sleeve 1 of the gown 10.

In accordance with the embodiments of the disclosure, the present description relates to a sleeve end or cuff 2 of a gown 10 that incorporates a thumb, finger, or fingers, hole 4 design specifically intended for the sleeve 1 or cuff 2 to be anchored in place with respect to the hand 8 and/or fingers. The design of which is specific to providing superior glove and sleeve integrity, thereby preventing the cuff 2 material or sleeve end from retracting from inside the glove cuff junction, and or providing superior wrist, palm and back of hand 8 protection.

Materials used for the gown 10 and/or cuff 2 can be made of any materials normally used and or responsive to the personal protection equipment PPE needs. The perforations 3 and position for the thumb and/or pinkie perforations 3*a*, 3*b*, only, allows for a user to choose not to use the thumb and/or pinkie perforations 3*a*,3*b* (e.g. as shown in FIG. 3) without compromising the integrity of the cuff 2 and wrist, and so not compromising aseptic technique.

Hospital-type gowns 10 are widely used in hospitals, nursing homes, rest homes, doctor's offices, and the like by health professionals, such as surgeons, doctors, nurses, nurse's aides, and the like; and, particularly where there is the possibility of coming into contact with contaminated body fluids, every effort is made to protect the health professional and public. Health professionals routinely use (wear) such hospital-type gowns 10 to either perform surgery or assist in surgery, draw blood, work with specimens containing contaminated fluids, or work where there might be a spill of contaminated fluids. Especially in instances where patients may have transferable disease, the health professional wants to have as much protection as possible. Hospital-type gowns 10 proposed heretofore usually are provided with sleeves 1 each terminating in a cuff 2 at the outer end which is usually in the form of a stretchable cuff made of stockinette material folded over and attached to the end of the sleeve 1. Even though health professionals such as nurses, for example, often wear short stretchable gloves with their prior art gowns 10, such gloves 9 often do not completely cover the cuffs 2 of their gowns 10 leaving exposed areas at the upper ends of such cuffs 2 and their wrists. Even longer surgical gloves 9 easily allow the cuff to be pulled out or exposed from movement, reaching, and or movement necessary to perform the clinical work needed. Materials for the cuff 2 are typically but not limited to a folded over stockinette attached to the end of the sleeve 1 providing at least two layers (e.g., a top layer 6 and a bottom layer 7) of absorbent material, as shown in FIG. 2 for example.

Thus, present hospital-type gowns 10 have a deficiency in that the distal ends of sleeves 1 of such gowns 10 usually do not provide protection against liquid permeating therethrough, as by their design, and often retract exposing the cuff 2 and/or wrist. This is a surgical break in technique and is considered a "contamination" of a sterile procedure and must be rectified the moment it is recognized. When a cuff 2, (whether the cuff 2 is superior in absorption or not, is irrelevant) or sleeve end slides out of the glove 9, there is a breakdown of sterile and aseptic technique. With 35 years personal experience in the operating room and Personal Protection Equipment (PPE) use, this is a serious and often unaddressed contamination issue. In surgery for example, such a break in sterile technique it is necessary to change the gown 10 and gloves 9 for new ones, simply put; it is a break in sterility in surgery. Thus, understood it is also imperative to maintain proper aseptic technique from surgery to covid and flu isolation situations. Specifically, if the sleeve end or cuff 2 has retracted from the glove 9 exposing the wrist, or cuff 2, we have then defeated part and purpose of the protective equipment, creating greater exposure for wearer, and community. Thus, present art gowns 10 have a deficiency in managing cuff 2 and or sleeve end, with glove/cuff integrity.

In providing superior surgical and aseptic techniques disclosed, including superior wrist, palm, and back of the hand 8 protection. It is important to address that the method of anchoring the sleeve 1 or cuff 2 is important in maintaining aseptic or sterile barrier and mainlining the sleeve 1 or cuff end anchored properly inside the glove 9 requires specific methods to attain this goal.

To that end, a simple undefined thumb or finger hole would not be obvious; in such a reference; an undefined or simple hole or holes, for example can be accomplished in several various ways that would fail, for example leaving a hole in the cuff, compromising the integrity of cuff and thus the aseptic technique, if unused for a digit, and thus would degrade the quality of cuff and glove integrity, causing a break in sterility, a contamination, thus defeating the very purpose of the protection equipment, sterility, sterile and aseptic technique, patient and staff safety. The intention of this disclosure utility is specific to sleeve 1 and cuff 2 providing more consistent integrity and protection via its retention within the glove 9, retention with respect to maintaining sterile technique, and safer technique when doffing the gown 10 and gloves 9, due to how the cuff 2 and/or fingers inserted into the holes 4 are s anchored within the glove 9 with respect to the finger, fingers, thumb, and or hand 8 is germane to proper surgical and aseptic technique and so to this disclosure.

In reference to the embodiments, the type of or exact position of hole or finger anchor design varies as responsive to surgical application needs. Such integrity is essential for patient safety. Orthopedic applications for example need greater protection for the palm and back of hand 8, while being anchored to one or more than one finger and possible palm padding, e.g. as shown by padding 710 in a non-limiting example in FIG. 7, creates better sterile protection. This may be important as large, heavy hammers are often used in orthopedic surgery and/or powerful pneumatic equipment is commonly used. While surgical applications are more important as such contaminations can lead to infection, delayed healing, or even death, the same breakdowns create the same results in less invasive applications, allowing the spread of microorganisms, such as COVID. It becomes more common and likely to spread the flu to a patient or other individual whenever a clinician for example, is in a patient isolation gown, and one can see the caregivers cuff 2 and/or wrist. That technique has broken down, part and purpose of the PPE has been defeated. When such a contamination occurs, extra techniques are necessary to follow proper hand washing and universal precautions as the protection equipment has been compromised, and a break in proper routine that now must be addressed.

Procedures that require heavy or sustained physical motion, such as orthopedic surgery, liposuction, and or the use of pneumatic equipment relate to a constant motion or turbulence, and even simple reaching or stretching to help or hold, often result in the cuff sliding out of the glove end and contaminating the sterile field and or the procedure. Anchoring the sleeve end or cuff prevents the cuff or gown end from retracting due to violent movement, reaching or stretching gestures, turbulence, or pneumatic vibration.

In a non-limiting embodiment, the thumb perforations 3*a* are to be lined up or aligned with the inner seam position of the sleeve 1, and the pinkie perforation 3*b* may be lined up or aligned with the lateral outer seam of the sleeve 1. The size of the perforations 3 may vary to accommodate the various size digits that will accompany the various gown sizes, which may be available from small to XXXXL. The perforation 3 for the thumb (e.g. 3*a* as shown in FIG. 3) or the pinkie (e.g., pinkie perforation 3*b* as shown in FIG. 3) will be positioned accordingly, approximately, but not limited to a half inch from the distal end of the cuff 2 and/or sleeve end.

Materials for the gown 10, sleeve 1 end, and/or cuff 2 will meet various levels of fluid protection and/or padding, including, but not limited to the Association for the Advancement of Medical Instrumentation (AAMI) proposed uniform classification system for gowns and drapes based on their liquid barrier performance. These procedures were adopted by the American National Standards Institute (ANSI) and were published as ANSIA/AAMI PB70: 2012 entitled Liquid Barrier Performance and Classification of Protective Apparel and Drapes Intended for Use in Health Care Facilities, which was formally recognized by the U.S. Food and Drug Administration in October, 2004. This standard established four levels of barrier protection for surgical gowns and drapes. The requirements for the design and construction of surgical gowns 10 are based on the anticipated location and degree of liquid contact, given the expected conditions of use of the gowns 10. The highest level of imperviousness is AAMI level 4, used in "critical zones" where exposure to blood or other bodily fluids is most likely and voluminous. The AAMI standards define "critical zones" as the front of the gown 10 (chest), including the tie cord/securing means attachment area, and the sleeves 1 and sleeve seam area up to about 2 inches (5 cm) above the elbow.

Surgical asepsis and sterile techniques maintain very strict parameters on what is sterile and what is a contamination or breakdown of what we call a sterile technique, or the sterile field. The sleeve end or cuffs 2 of the gown are enclosed beneath sterile gloves 9. The cuff 2 is often absorbent and retains moisture, therefore, this part of the gown 10 does not provide a microbial barrier and permits the transfer of micro-organisms. Once the cuff 2 has been contained within the closed glove 10, it should not be pulled back over the hand 8 for any reason or re-gloving procedure because it is contaminated (not sterile, and not to be introduced into the sterile field).

Alexanders patient in surgery 16$^{th}$ edition, Page, 321 "4. Sterile gowns are considered sterile in front from the chest to the level of the sterile field and at the sleeves from 2 inches above the elbow to the cuff. The cuff should be considered unsterile because it tends to collect moisture and is not an effective bacterial barrier. The sleeve cuffs should always be covered by sterile gloves."

To further explain the contamination or break in sterile technique, and the severity of the issue; Association of Operating Room Nurses (AORN) standards, 2017 ed. p. 81, Sterile Technique, Item III.d.1 "Sleeve cuffs of the surgical gown should be considered contaminated when the scrubbed team members hands pass through and beyond the cuff. Sleeve cuffs are not often not impervious and could allow for microbial transfer from the scrubbed team member's hand 8.

And the next item, same page: III.d.2. "Sleeve cuffs should be completely covered by sterile gloves and should not be exposed. Permeable sleeve cuffs that are not completely covered by sterile gloves may allow for microbial transfer and contact from the scrubbed team members arms to the patient, and for contact with blood and body fluids from the patient to the scrubbed team member."

An advantage to the invention, is when removing gown 10 and gloves 9, the gloves 9 will tend to come off with the gown 10, instead of remaining on the hands 8 and needing removal without touching the outsides of the gloves 9. Often done by placing a finger inside the dirty glove 9 to remove it after the gown 10 is removed. The gloves 9 being removed by taking off the gown 10, as it is anchored to a finger inside the glove 9, thus pulling the glove 9 off of the finger or fingers and thereby providing a superior technique for post-surgical dirty glove removal.

It should be appreciated by those skilled in the art that various modifications and variations can be made to the embodiments of the present invention described and illustrated herein without departing from the scope and spirit of the invention. The invention includes such modifications and variations coming within the meaning and range of the invention.

While various aspects of the invention have been disclosed herein, other aspects are contemplated. Furthermore, terms like "responsive to," "related to," or other past-tense adjectives are generally not intended to exclude such variants, unless context dictates otherwise. Language herein is generally intended as "open" terms (e.g., the term "including" should be interpreted as "including but not limited to, "the term "having" should be interpreted as "having at least, "the term "includes" should be interpreted as "includes but is not limited to, ", and "gown sleeve end" and "cuff" can both be interpreted as the far distal end of the garment if there is not a separate material to designate gown sleeve material from the material of the "cuff", etc.) The various aspects and disclosed herein are intended to be comprehensible to the human mind and are not intended to be limiting, with the true scope and spirit being indicated by the following claims.

What is claimed is:

1. An apparatus comprising:

a sterile surgical gown having a sleeve end and a cuff attached to sleeve end, wherein the cuff comprises a thumb perforation, wherein the thumb perforation is a narrow opening or slit located a distance below a top edge of the cuff that is configured to receive a thumb, wherein the thumb perforation is not a widened hole prior to insertion of the thumb into the perforation, wherein the thumb perforation only allows a single thumb to be entered through the thumb perforation, wherein the thumb perforation does not break the sterility of the sterile surgical gown.

2. The apparatus of claim 1, wherein the thumb perforation comprises a breakable seal to prevent the thumb perforation from opening until a force of a thumb is applied to the thumb perforation.

3. The apparatus of claim 2, wherein the breakable seal is a heat seal.

4. The apparatus of claim 1, wherein the thumb perforation is for selective use of perforation, such that the cuff, and/or cuff integrity are kept intact and aseptic technique is not compromised, regardless of whether a user perforates the thumb perforation.

5. The apparatus of claim 1, further comprising, a pinkie perforation, wherein the pinkie perforation is an additional narrow opening or slit configured to receive a pinkie finger, wherein the pinkie perforation is not a widened hole, wherein the pinkie perforation is located in the cuff of the sterile surgical gown.

6. The apparatus of claim 5, wherein the pinkie perforation comprises a breakable seal.

7. The apparatus of claim 6, wherein the breakable seal is a heat seal.

* * * * *